United States Patent [19]

Kaiser et al.

[11] Patent Number: 4,645,559

[45] Date of Patent: Feb. 24, 1987

[54] APPARATUS FOR BONDING SHEET-LIKE TEXTILE PIECES

[75] Inventors: Albrecht Kaiser, Vlotho, Fed. Rep. of Germany; Hans-Jürg Schäublin, Riehen, Switzerland

[73] Assignee: Herbert Kannegiesser GmbH & Co., Vlotho, Fed. Rep. of Germany

[21] Appl. No.: 697,365

[22] Filed: Feb. 1, 1985

[30] Foreign Application Priority Data

Feb. 16, 1984 [DE] Fed. Rep. of Germany ..... 3405505

[51] Int. Cl.[4] ..... B30B 15/30; B30B 15/34

[52] U.S. Cl. ..... 156/583.1; 100/93 P; 100/215; 156/583.9; 219/243

[58] Field of Search ..... 156/583.1, 580, 583.8, 156/583.9; 100/93 P, 215; 219/243

[56] References Cited

U.S. PATENT DOCUMENTS

| | | | |
|---|---|---|---|
| 2,661,789 | 12/1953 | Keller | 100/93 P |
| 3,567,560 | 3/1971 | Stiff | 100/93 P |
| 4,452,662 | 6/1984 | Pettersson | 156/583.1 |

*Primary Examiner*—Michael Wityshyn

*Attorney, Agent, or Firm*—Sughrue, Mion, Zinn, Macpeak and Seas

[57] ABSTRACT

For the (partial) bonding of textile pieces, that is to say (large) outer material parts 10 to (small) interlinings 11, outer material parts 10 in bundles 14 are fixed in front of press plates 12, 13 by means of a holding device 15, and only regions 22 of the outer material parts 10 intended for bonding are introduced between the press plates 12, 13, specifically after previous preparation, that is to say positioning, of the interlining 11 on a layout surface 23 on the top side of the upper press plate 12.

11 Claims, 4 Drawing Figures

APPARATUS FOR BONDING SHEET-LIKE TEXTILE PIECES

Figure 1:
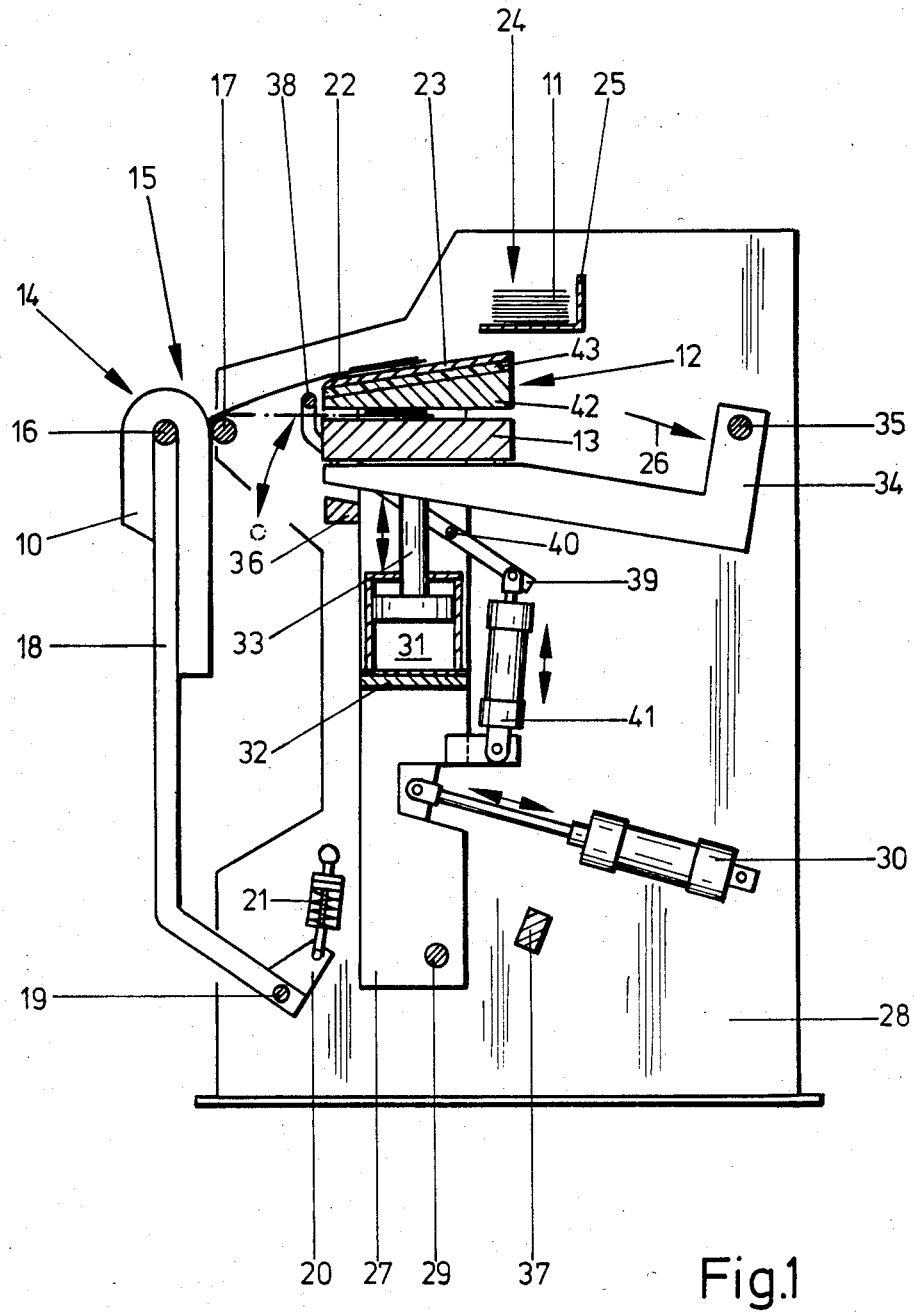

The invention relates to an apparatus for bonding sheet-like textile pieces, especially those for outer garments, in which the textile pieces to be bonded to one another (outer material part and interlining) are bonded to one another between press plates movable relative to one another, with heat and pressure being applied, a feeder station for manually laying the textile pieces to be bonded together on one another being arranged on the tending side.

In a known apparatus of this type (German Patent Specification No. 1,953,577), pairs of press plates are arranged in the region of pressing stations on both sides of a conveyor belt for the textile pieces. These are laid onto the conveyor belt and onto one another in the region of a feeder station and are then conveyed into the pressing stations and out of these again. When relatively small textile pieces are processed by means of this known bonding press, it is customary to lay them onto the conveyor belt next to one another in succession in the conveying direction.

The textile pieces to be bonded to one another are mainly supplied to the apparatus as bundles. The bonded textile pieces leaving the bonding press will, when their content corresponds to that of the bundles supplied, be combined again in an appropriate way. This conveyance encounters difficulties when the apparatus has a large working width and when several attendants are employed on both the feed and delivery sides.

The known apparatuses are also uneconomic when interlinings which are small in relation to the outer material parts are to be bonded to the latter and are to be placed off-center, for example in the region of the hems and button strips. They are uneconomic, on the one hand because of the labor force required, and on the other hand because of the heating of the press plates which are excessively large for partial bonding.

The object on which the invention is based is to propose an apparatus for bonding textile pieces, which makes it possible to achieve economical, energy-saving operation, even when textile pieces of different sizes are to be bonded (partially), and furthermore when the predetermined bundles of textile pieces are to be retained after bonding.

The apparatus according to the invention makes it possible to work in such a way that the bundles of textile pieces supplied, especially outer material parts, are fixed (held) outside the region of the press plates, and only the regions to be bonded to an associated textile piece (interlining) are introduced between the press plates, with the bundle being preserved. It thus becomes possible to utilize the press plates more efficiently or have press plates of smaller dimensions. Furthermore, the predetermined bundle is preserved without being broken up in the meantime and recombined.

According to the invention, the procedure here is that the bundled outer material fixed in bundles on the tending side are turned over in succession with the part to be bonded, in the manner of pages of a book and are introduced, together with the interlining, between the press plates. After bonding, these free regions of the outer material parts, together with the interlinings, are moved out of the region between the press plates and brought into a hanging position directed downwards. The bundle consequently experiences no change of location, but remains fixed in the holding device until all the outer material parts have been provided with an interlining.

Special economic advantage is achieved when the outer material parts to be bonded or the regions receiving the interlining, whilst continuing to be bound in the bundle, are laid onto the top side of the upper press late, that is to say onto the layout surface of the latter, and the interlining is then brought into the desired position. The textile pieces to be bonded to one another are then prepared for bonding on the bench-like top side of the upper press plate, whilst at the same time a bonding cycle is executed. The upper press plate is then moved out of the pressing position, and on the one hand the bonded textile piece slides into the downward-directed position and on the other hand the prepared outer material part, that is the part provided with an interlining, slides into the region between the press plates, namely onto the exposed lower press plate. Very short cycle times are possible as a result.

According to a further proposal of the invention, the textile pieces bonded to one another are moved out of the essentially horizontally directed bonding position into the downward-directed collecting position by a movable member, namely a draw-off rod, as a result of the downward movement of the latter.

Further features of the invention relate to the constructional design of the holding device for the textile pieces, to the mounting and design of the press plates and draw-off rod and to further constructive details.

Figure 2:
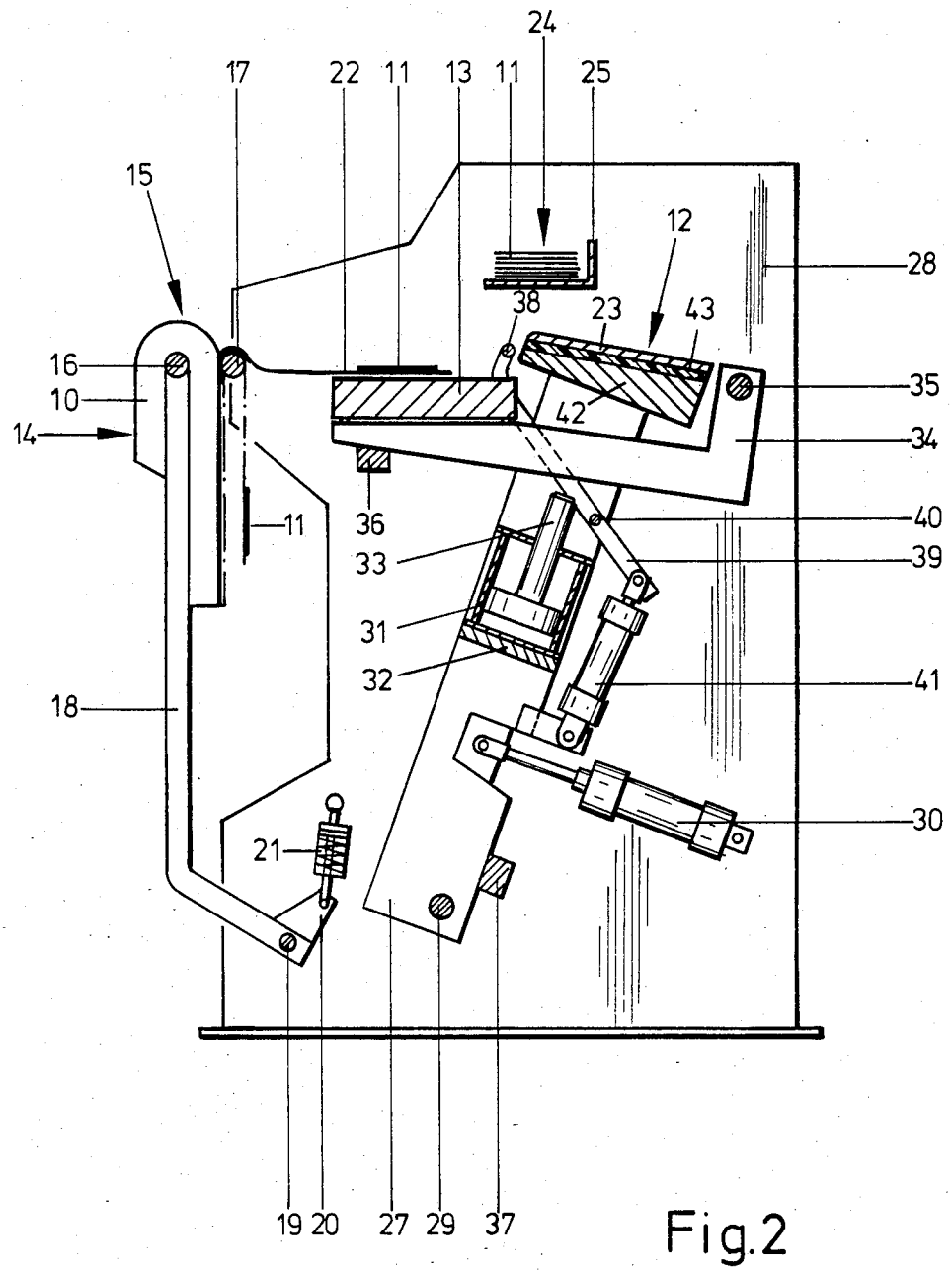
Figure 3:
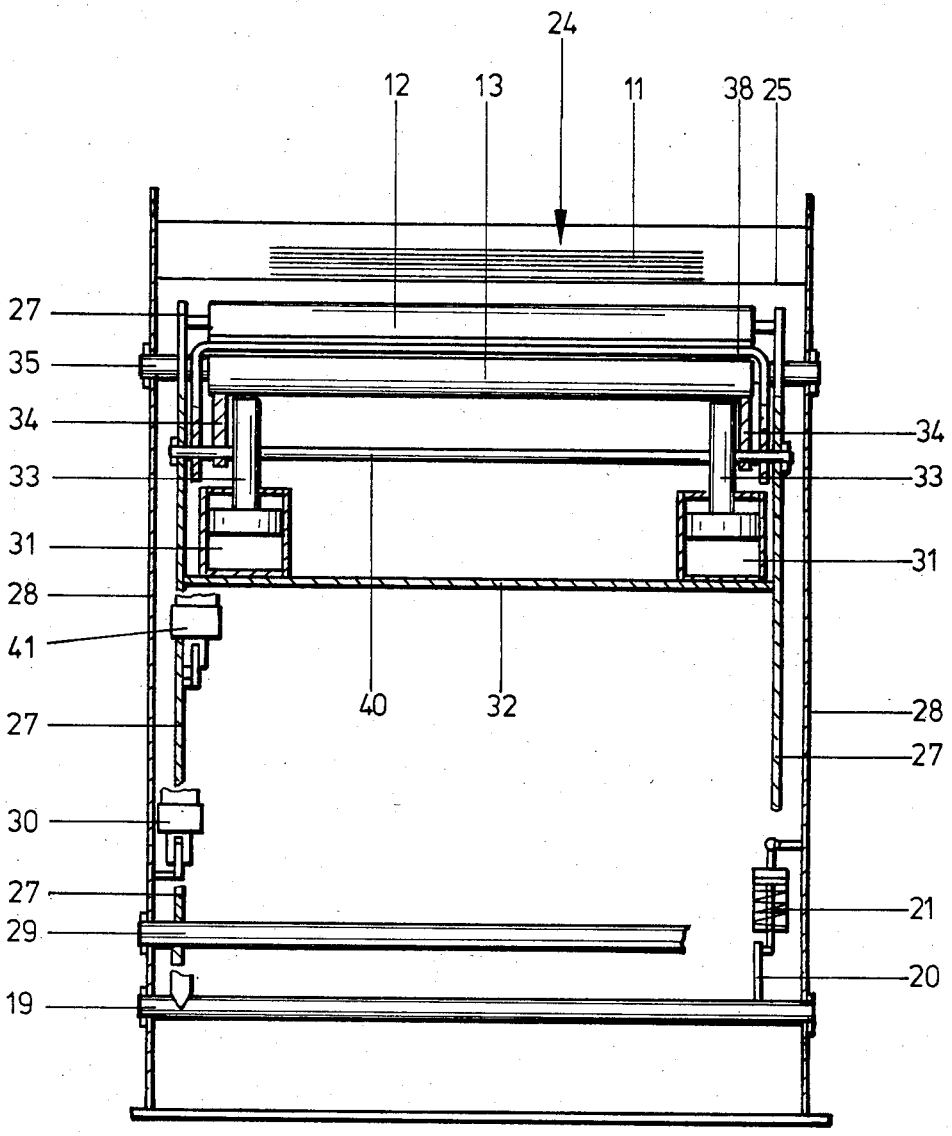
Figure 4:
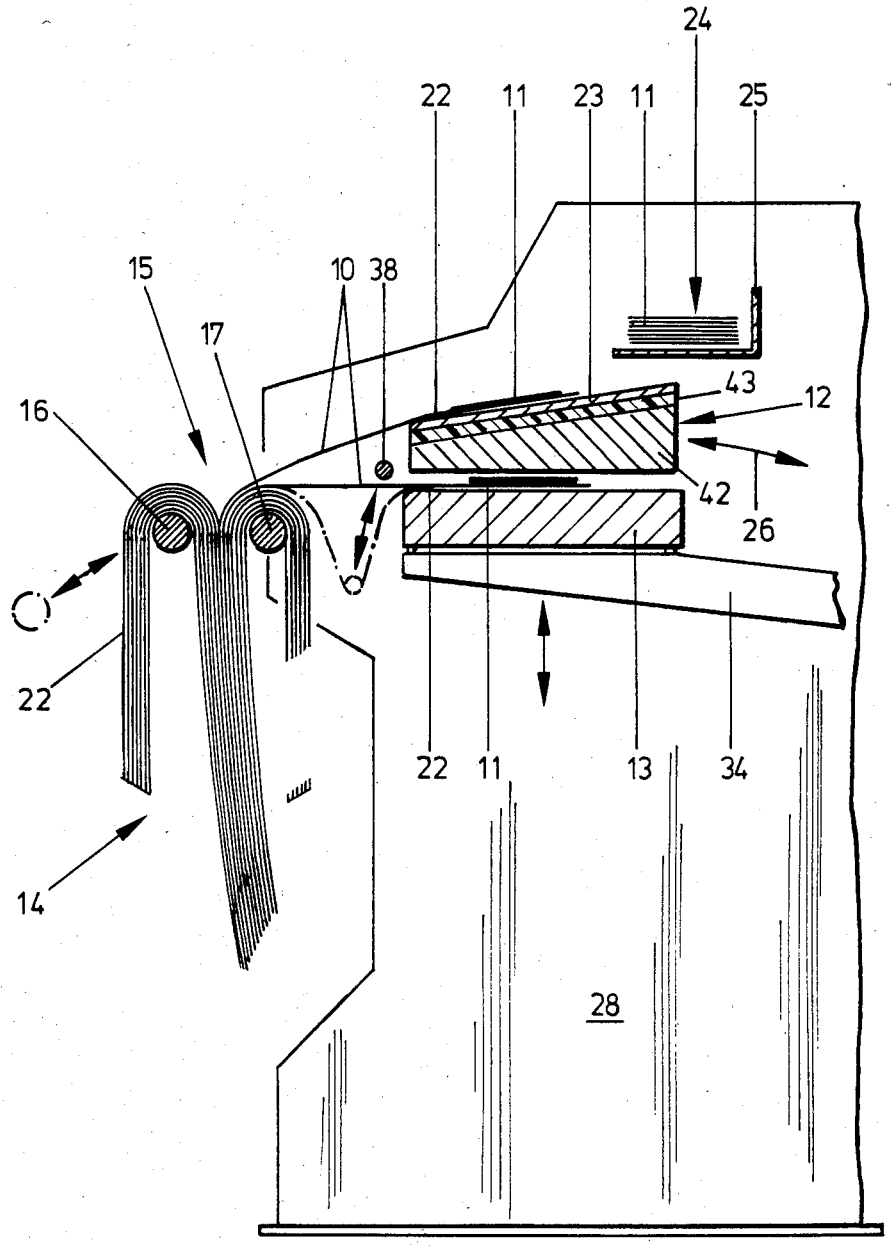

An exemplary embodiment of the invention is explained in more detail below with reference to the drawings in which:

FIG. 1 shows the apparatus (bonding press) in a diagrammatic longitudinal section, with the press plates closed, FIG. 2 shows a representation corresponding to that of FIG. 1, with the press plates opened, FIG. 3 shows a cross-section through the apparatus according to FIGS. 1 and 2, FIG. 4 shows a longitudinal section through essential individual parts of the apparatus on an enlarged scale, with the working method being illustrated.

The apparatus shown in the drawings serves for bonding textile pieces by means of heat and pressure. These are mainly outer material parts 10 and interlinings 11. In the present case, these are to be bonded to one another in such a way that the interlining 11 of small area in relation to the outer material part 10 is to be joined to the latter off-center, that is to say in the edge region of the latter.

For this purpose, only the region of the outer material part 10 to be subjected to heat and pressure is moved between two press plates 12 and 13. These are heated. Bonding is carried out when the press plates 12 and 13 are moved relative to one another, and in the present case, in the bonding position (FIG. 1 and FIG. 4), the lower press plate 13 is moved upwards against the upper press plate 12 or against the textile pieces received between them.

In the present case, the outer material parts 10 are supplied to the apparatus in bundles and are also processed in this form. For this purpose, a bundle 14 of this type is fixed at working height on the tending or operator side of the apparatus, that is to say in front of the press plates 12, 13. In the present exemplary embodiment, a holding device 15 for temporarily receiving the bundle 14 consists of two retaining rods 16 and 17 movable relative to one another for clamping. These extend essentially horizontally and at the same height, at a distance from one another, transversely in front of the press plates 12 and 13. The retaining rods 16 and 17 can be moved apart from one another against spring pressure, so that the bundle 14 can be received and clamped between the retaining rods 16 and 17. In the present exemplary embodiment, the retaining rod 17 facing the press plates 12, 13 is arranged fixed in place, whilst the outer retaining rod 16 is supported pivotably in a bearing 19 via lateral supporting arms 18. An extension 20 adjoining the supporting arm 18 is loaded by a spring 21 which prestresses the supporting arm 18 and consequently the retaining rod 16 in the clamping direction, that is to say in the direction of the retaining rod 17. The retaining rod 16 can be moved back against the load of the spring 21 by hand and the bundle 14 thereby introduced or removed.

In the initial position, the bundle 14 of outer material parts not yet provided with an interlining 11 is clamped in such a way that the entire bundle hangs on the outer retaining rod 16 remote from the press plates 12, 13. At the same time, a region 22 of the outer material parts 10, which is to be provided with the interlining 11, hangs on the outside, that is to say facing the attendant.

To bond the interlinings 11 on the outer material parts 10, the regions 22 of the outer material parts 10 are introduced in succession between the press plates 12 and 13 by being turned over in the manner of the pages of a book, after the interlining 11 has previously been laid on. The respective regions 22 of the outer material parts 10 are pivoted through virtually 270° during this operation.

After the interlining 11 has been bonded to the outer material part 10, without any change in the position of the bundle 14, the region 22 of the outer material part 10 provided with the interlining 11 is moved downwards into a hanging position in the region between the retaining rod 17 and the press plates (FIG. 4). The outer material parts 10 thus treated now hang solely on the retaining rod 17.

To prepare the outer material part 10 and interlining 11 for the bonding operation, the outer material part 10 or the region 22 is laid onto an intermediate support, that is to say onto the top side of the upper press plate 12, when this is located in the bonding position according to FIG. 1 and FIG. 4. For this purpose, the press plate 12 is provided with an upper bench-like layout surface 23 which is designed to slope downwards in the manner of a shed roof, that is to say towards the tending side. The interlining 11 is laid in the correct position onto the region 22 of an outer material part 10 spread out on the layout surface 23. This preparatory activity takes place completely or partially during a pressing or bonding cycle.

To make it easy to handle the textile pieces, a stack 24 of interlinings 11 is provided on an interlining holder 25 of angular cross-section. This is arranged above the upper press plate 12, specifically in a region remote from the tending side, but in any case outside that part of the layout surface 23 serving for receiving the outer material part 10. In this way, the interlinings 11 can be brought into the required position over a short distance.

The outer material part 10, or its region 22, provided with an interlining 11 is brought into the pressing position, that is to say into an essentially horizontal position resting on the top side of the lower press plate 13, as a result of the displacement of the upper press plate 12 when it slides down from the latter. For this purpose, in the present exemplary embodiment, the upper press plate 12 is displaced approximately in the plane of the pressing surfaces or in the tending direction into an opening position remote from the tending side, as shown in FIG. 2. The region 22 of the outer material part 10 thereby automatically comes into the pressing position on the lower press plate 13. When the press plate 12 is now returned to the initial position (the to-and-fro movement according to the arrow 26), the pressing operation can take place. At the same time, the upper press plate 12 is ready again to receive the next outer material part 10.

To execute the movements according to the arrow 26, the upper press plate 12 is attached to the top ends of supporting spars 27 arranged laterally. These are in turn received between side walls 28 of a machine frame. The bottom ends of the supporting spars 27 are supported in a pivot bearing which, in the present case, consists of a transversely directed supporting rod 29 mounted in the side walls 28. To execute the pivoting movements of the supporting spars 27 and consequently the to-and-fro movement of the press plate 12, a laterally arranged pressure-medium cylinder 30 connected to the adjacent side wall 28 is used here.

In the present case, to carry out the pressing operation, the lower press plate 13 is moved against the upper press plate 12 which is stationary during this time. For this purpose, two lateral pressure cylinders 31 are provided which are attached to the supporting spars 27 or to a cross member 32 connecting these to one another. Piston rods 33 of the pressure cylinders 31 can be extended up against the underside of the press plate 13 in the pressing position.

In the exemplary embodiment illustrated, the lower press plate 13 is arranged on the lateral supporting strut 34. By means of an (angled) end remote from the tending side, these are held in a pivot bearing consisting, here, of a bearing rod 35 directed transversely. This is fastened to the side walls 28 in a region allowing free movement of the upper press plate 12 (FIG. 2). The up-and-down movement of the lower press plate 13 is executed through an arc of a circle about the bearing rod 35. The lower initial position of the press plate 13 is defined by a fixed stop 36 for the supporting struts 34. Likewise, the retracted position of the press plate 12, remote from the press plate 13, is fixed by a stop 37 for the supporting spars 27.

In order to bring the region 22 of the outer material part 10 out of the pressing position into the downward-directed stand-by position after the press plates 12, 13 have been opened, a stripping member is provided which consists of a transversely directed draw-off rod 38. This is moved up and down in the region between the holding device 15 and the press plates 12, 13, and as a result of its downward movement from an upper position according to FIG. 4 into the lower position represented by dot-and-dash lines, the region 22 of the outer material part 10 is carried along.

The draw-off rod 38 is connected via lateral pivoting levers 39 or a transversely directed bearing rod 40 to the supporting spars 27 and is consequently moved to and fro together with these. An actuating cylinder 41, likewise arranged laterally on the supporting spars 27, executes the movements of the pivoting lever 39 and consequently the up-and-down movement of the draw-off rod 38.

During the pressing operation or during the time when an outer material part is laid onto the upper press plate 12, the draw-off rod 38 is in the upper position, that is to say underneath the prepared outer material part 10. When the upper press plate 12 moves back into the position according to FIG. 2, the draw-off rod 38 automatically assumes a pqsition above the plane of the outer material part 10 moved into the pressing position. After the press plate 12 has returned to the initial position, although the draw-off rod 38 maintains its upper position unchanged, nevertheless it is now located above the outer material part 10 to be stripped off later. The stripping-off operation is carried out by means of the actuating cylinder 41 at the appropriate time.

In a further development of the exemplary embodiment illustrated, the apparatus can be designed so that several holding devices 15 are provided next to one another and can be actuated separately, in order to allow several attendants to work independently in the way described above.

In the present exemplary embodiment, the upper press plate 12 is of trapezoidal cross-section. The layout surface 23 is divided off from the remaining (heated) part 42 of the press plate 12 by insulation 43. This on the one hand prevents heat from being dissipated upwards, but on the other hand prevents undesirable heating of the layout surface 23. The insulation 43 can, if appropriate, be designed as a layer of air.

We claim:

1. An apparatus for bonding together first and second sheet-like textile pieces, especially those for outer garments, said textile pieces being bonded to one another between relatively movable press plates with the application of heat and pressure, a feeder station for manually laying the textile pieces to be bonded together on one another being disposed on an operator side of the apparatus, said apparatus being characterized by:

(a) a top side of an upper press plate (12) having a layout surface (23) for first and second textile pieces (10, 11) to be bonded to one another, (b) means for moving the upper press plate towards and away from the operator side of the apparatus (arrow 26), and (c) a device (15) on the operator side of the apparatus, arranged in front of the layout surface, for holding a bundle of said first textile pieces to be individually laid onto said layout surface.

2. An apparatus as claimed in claim 1, wherein an interlining holder (25) for said second textile pieces (11) to be laid onto the layout surface (23) is arranged above the layout surface (23) and on a side thereof remote from the operator side.

3. An apparatus as claimed in claims 1 or 2, wherein a lower press plate (13) located opposite the upper press plate (12) is vertically movable and can be pressed against the upper press plate, with the textile pieces (10, 11) to be bonded to one another being sandwiched between said upper and lower plates.

4. An apparatus as claimed in claim 1, wherein insulation (43) is arranged between the layout surface (23) and a lower heated part (42) of the upper press plate (12).

5. An apparatus as claimed in claim 1, wherein the holding device (15) has two transversely directed clamping members arranged at a distance from one another and movable relative to one another, especially horizontal retaining rods (16, 17), for the clamping retention of textile piece bundles (14) hanging over them.

6. An apparatus as claimed in claim 1, wherein a stripping member, especially a vertically movable draw-off rod (38), is arranged between the press plates (12, 13) and the holding device (15), for stripping bonded textile pieces from a lower one of the press plates (13).

7. An apparatus as claimed in claim 6, wherein the draw-off rod (38) is movable together with the upper plate (12), in such a way that, when the upper press plate moves towards and away from the operator side, the draw-off rod (38) remains in a position above the textile pieces (10, 11) to be bonded to one another.

8. An apparatus as claimed in claims 6 or 7, wherein the draw-off rod (38) is mounted on a movable support spar (27) of the upper press plate (12) so as to be movable up and down or pivotable.

9. An apparatus as claimed in claim 1, wherein the layout surface (23) of the upper press plate (12) is inclined downwardly towards the operator side, and said upper press plate has a trapezoidal cross-section.

10. An apparatus as claimed in claim 1, wherein the upper press plate (12) is arranged on lateral support spars (27) which are mounted pivotably at their lower ends.

11. An apparatus as claimed in claim 1, wherein the lower press plate (13) is carried by pivotable support struts (34) which are directed essentially horizontally, and a pivot bearing rod (35) of said struts is arranged on a side of the apparatus opposite the operator side and spaced from the press plates.

* * * * *